US009725924B2

(12) United States Patent
Hashemi et al.

(10) Patent No.: US 9,725,924 B2
(45) Date of Patent: Aug. 8, 2017

(54) DRAWER SLIDE AND ELECTRONICALLY ACTUATED LOCKING MECHANISM

(71) Applicants: Darush David Hashemi, Santa Fe Springs, CA (US); Xiaoping Zhou, Santa Fe Springs, CA (US); Quinn Chi, Santa Fe Springs, CA (US)

(72) Inventors: Darush David Hashemi, Santa Fe Springs, CA (US); Xiaoping Zhou, Santa Fe Springs, CA (US); Quinn Chi, Santa Fe Springs, CA (US)

(73) Assignee: Accuride Internatioanl Inc., Santa Fe Springs, CA (US)

( * ) Notice: Subject to any disclaimer, the term of this patent is extended or adjusted under 35 U.S.C. 154(b) by 107 days.

(21) Appl. No.: 13/945,831

(22) Filed: Jul. 18, 2013

(65) Prior Publication Data

US 2014/0021843 A1 Jan. 23, 2014

Related U.S. Application Data

(60) Provisional application No. 61/673,159, filed on Jul. 18, 2012.

(51) Int. Cl.
*E05C 3/06* (2006.01)
*E05B 47/00* (2006.01)
(Continued)

(52) U.S. Cl.
CPC ..... *E05B 47/0001* (2013.01); *E05B 47/0012* (2013.01); *E05B 47/06* (2013.01);
(Continued)

(58) Field of Classification Search
CPC ..... Y10T 292/1082; Y10T 292/699; Y10T 292/1021; Y10T 70/7062; E05B 81/14; E05B 81/64
(Continued)

(56) References Cited

U.S. PATENT DOCUMENTS 3,347,584 A 10/1967 Johnstone
3,439,948 A 4/1969 Smith
(Continued)

FOREIGN PATENT DOCUMENTS

EP 159238 A1 10/1985
JP 5-087176 11/1993
(Continued)

OTHER PUBLICATIONS

International Search Report on related PCT Application No. PCT/US2010/032623 from International Searching Authority (KIPO) dated Jan. 28, 2011.
(Continued)

*Primary Examiner* — Mark Williams
(74) *Attorney, Agent, or Firm* — Klein, O'Neill & Singh, LLP

(57) ABSTRACT

An electrically actuated locking mechanism may include a microprocessor for control of the locking mechanism, and the locking mechanism may be used to lock a drawer slide in a closed position. The microprocessor may be in a housing of the locking mechanism, and the microprocessor may command a motor to operate in a first direction to drive lock components to a locked status and command the motor to operate in a second direction to drive the lock components to an unlocked state.

9 Claims, 12 Drawing Sheets

(51) Int. Cl.
*E05B 65/46* (2017.01)
*E05B 47/06* (2006.01)
*E05C 3/24* (2006.01)

(52) U.S. Cl.
CPC ..... *E05B 65/46* (2013.01); *E05C 3/24* (2013.01); *E05B 2047/0024* (2013.01); *E05B 2047/0069* (2013.01); *E05B 2047/0094* (2013.01); *Y10T 70/7062* (2015.04)

(58) Field of Classification Search
USPC ..... 292/201, 216
See application file for complete search history.

(56) References Cited

U.S. PATENT DOCUMENTS

| | | | | |
|---|---|---|---|---|
| 3,504,511 | A | 4/1970 | Allen | |
| 3,664,698 | A | 5/1972 | Stropkay | |
| 4,268,076 | A | 5/1981 | Itoi | |
| 4,811,579 | A | 3/1989 | Lyons et al. | |
| 4,968,073 | A | 11/1990 | Kuhlman | |
| 4,969,672 | A | 11/1990 | Childs et al. | |
| 4,978,153 | A | 12/1990 | Hirsch et al. | |
| 5,392,951 | A | 2/1995 | Gardner et al. | |
| 5,484,179 | A | 1/1996 | Mader | |
| 5,498,040 | A | 3/1996 | Silye | |
| 5,518,282 | A | 5/1996 | Sawada | |
| 5,642,636 | A | 7/1997 | Mitsui | |
| 5,791,179 | A | 8/1998 | Brask | |
| 5,802,894 | A | 9/1998 | Jahrsetz et al. | |
| 5,901,991 | A * | 5/1999 | Hugel et al. | 292/201 |
| 5,934,717 | A | 8/1999 | Wirths et al. | |
| 6,008,992 | A | 12/1999 | Kawakami | |
| 6,027,148 | A | 2/2000 | Shoemaker | |
| 6,050,117 | A | 4/2000 | Weyerstall | |
| 6,089,626 | A | 7/2000 | Shoemaker | |
| 6,155,124 | A | 12/2000 | Wirths | |
| 6,310,411 | B1 | 10/2001 | Viallet | |
| 6,318,136 | B1 | 11/2001 | Mauer | |
| 6,386,599 | B1 | 5/2002 | Chevalier | |
| 6,419,286 | B1 | 7/2002 | Szablewski | |
| 6,435,573 | B1 | 8/2002 | Szablewski | |
| 6,439,623 | B1 | 8/2002 | Lohfeld et al. | |
| 6,522,095 | B2 | 2/2003 | Kachouh | |
| 6,523,376 | B2 * | 2/2003 | Baukholt et al. | 70/256 |
| 6,588,243 | B1 | 7/2003 | Hyatt, Jr. et al. | |
| 6,619,085 | B1 | 9/2003 | Hsieh | |
| 6,648,380 | B1 | 11/2003 | Szablewski et al. | |
| 6,811,118 | B2 | 11/2004 | Collet et al. | |
| 6,814,281 | B2 | 11/2004 | Anderson et al. | |
| 6,848,727 | B1 * | 2/2005 | Cetnar et al. | 292/201 |
| 6,923,480 | B2 | 8/2005 | Shafry | |
| 6,932,393 | B2 | 8/2005 | Erices | |
| 7,004,386 | B2 | 2/2006 | Chien | |
| 7,059,513 | B2 | 6/2006 | Daugs et al. | |
| 7,111,877 | B2 | 9/2006 | Larsen et al. | |
| 7,131,673 | B2 | 11/2006 | Cherry et al. | |
| 7,165,428 | B2 | 1/2007 | Isaacs et al. | |
| 7,175,210 | B2 | 2/2007 | Orzech et al. | |
| 7,456,725 | B2 | 11/2008 | Denison et al. | |
| 7,458,651 | B1 | 12/2008 | Radke et al. | |
| 7,731,250 | B2 | 6/2010 | Garneau et al. | |
| 7,741,952 | B2 | 6/2010 | Denison et al. | |
| 7,766,397 | B2 | 8/2010 | Carabalona | |
| 7,878,560 | B1 | 2/2011 | Scheffler et al. | |
| 8,016,329 | B2 | 9/2011 | Johansson et al. | |
| 8,328,299 | B2 | 12/2012 | Hashemi et al. | |
| 8,341,958 | B2 | 1/2013 | Brown et al. | |
| 2002/0139157 | A1 | 10/2002 | Butera et al. | |
| 2003/0127866 | A1 | 7/2003 | Martinez et al. | |
| 2004/0113438 | A1 | 6/2004 | Kachouh | |
| 2004/0174021 | A1 | 9/2004 | Tensing et al. | |
| 2004/0212197 | A1 | 10/2004 | Shoemaker | |
| 2005/0127683 | A1 | 6/2005 | Nam | |
| 2005/0179349 | A1 | 8/2005 | Booth et al. | |
| 2006/0237974 | A1 | 10/2006 | Hamm et al. | |
| 2006/0267461 | A1 | 11/2006 | Hoffman | |
| 2007/0159038 | A1 | 7/2007 | Huang | |
| 2008/0231154 | A1 | 9/2008 | Rudduck et al. | |
| 2008/0246286 | A1 | 10/2008 | Ostrowski | |
| 2009/0231132 | A1 | 9/2009 | Shoenfeld | |
| 2009/0235767 | A1 * | 9/2009 | Garneau | E05B 47/0012 74/56 |
| 2009/0236865 | A1 | 9/2009 | Dziurdzia et al. | |
| 2009/0284025 | A1 | 11/2009 | Salcombe | |
| 2011/0056253 | A1 | 3/2011 | Greiner et al. | |
| 2011/0069914 | A1 * | 3/2011 | Hashemi | E05B 47/00 384/21 |
| 2011/0101839 | A1 | 5/2011 | Boks | |
| 2011/0227351 | A1 | 9/2011 | Grosdemouge | |
| 2012/0038177 | A1 | 2/2012 | Greiner et al. | |
| 2013/0069514 | A1 | 3/2013 | Hashemi et al. | |

FOREIGN PATENT DOCUMENTS

| | | | |
|---|---|---|---|
| JP | 08-289821 | | 11/1996 |
| JP | H 10-46893 | A | 2/1998 |
| JP | 10-215960 | | 8/1998 |
| JP | 2000-244786 | A | 9/2000 |
| JP | 2001-004141 | A | 1/2001 |
| JP | 2004-107884 | A | 4/2004 |
| JP | 2008-092762 | A | 4/2008 |
| JP | 2009-084830 | A | 4/2009 |
| JP | 2009-287251 | A | 12/2009 |
| JP | 3170803 | | 9/2011 |
| KR | 10-0679309 | | 2/2007 |
| KR | 20-0440074 | | 5/2008 |
| WO | WO 2010-129303 | A2 | 11/2010 |

OTHER PUBLICATIONS

Written Opinion on related PCT Application No. PCT/US2010/032623 from International Searching Authority (KIPO) dated Jan. 28, 2011.

International Search Report on related PCT Application No. PCT/US2013/051152 from International Searching Authority (KIPO) dated Nov. 1, 2013.

Written Opinion on related PCT Application No. PCT/US2013/051172 from International Searching Authority (KIPO) dated Nov. 1, 2013.

U.S. Appl. No. 12/768,669, filed Apr. 27, 2010, Hashemi et al., 2011-0069914, Office Action Aug. 23, 2012 Mar. 30, 2012 Notice of Allowance Oct. 1, 2012.

U.S. Appl. No. 13/674,778, filed Nov. 12, 2012, Hashemi et al., 2013-0069514, Office Action May 8, 2013.

U.S. Appl. No. 13/787,483, filed Mar. 6, 2013, 2013-0181588, Office Action Jun. 14, 2013.

Office Action on related Japanese Application No. 2015-520718 from the Japanese Patent Office (JPO) mailed on Dec. 15, 2015.

Office Action on related Canadian Patent Application No. 2876722 from the Canadian Intellectual Property Office mailed on Mar. 11, 2016.

Office Action on related Japanese Application No. 2015-520718 from the Japanese Patent Office (JPO) mailed on Nov. 29, 2016.

* cited by examiner

DRAWER SLIDE AND ELECTRONICALLY ACTUATED LOCKING MECHANISM

CROSS REFERENCE TO RELATED APPLICATIONS

This application claims the benefit of the filing date of U.S. Provisional Patent Application No. 61/673,159, filed Jul. 18, 2012, the disclosure of which is incorporated by reference herein.

BACKGROUND OF THE INVENTION

The present invention relates generally to drawer slides, and more particularly to drawer slides with locking mechanisms.

Drawer slides are often used to extendably couple drawers within cabinets or racks within frames. Using a cabinet application as an example, drawer slides generally have one member mounted to a drawer and another member mounted to a cabinet. The two members are extendably coupled together, often by way of ball bearings, so that the extension of the drawer slide provides for extension of the drawer from the cabinet, allowing for easy access to the contents of the drawer.

Unfortunately, uncontrolled easy access to contents of a drawer is not always desired. A drawer may contain items of a personal nature, or, as may often be the case in a commercial setting, the drawer may contain valuable items. Secure storage of such items may be an important consideration, and drawer slides, with the ease of access they provide, may not be an appropriate.

More secure storage, for example as provided by a safe or a lock box, may also not always be appropriate. At times frequent and repeated access to stowed items may be required, albeit in a controlled manner. Moreover, structures associated with safes and lock boxes may be somewhat bulky, and not easily incorporated in a cabinet type structure which otherwise may be desired.

BRIEF SUMMARY OF THE INVENTION

Aspects of the invention provide a drawer slide and electronically actuated lock mechanism.

One aspect of the invention provides an assembly including a lock mechanism, comprising: a housing for mounting within a cabinet; a latch receiver rotatably mounted at least partially within the housing; a lever arm rotatably mounted at least partially within the housing, the lever arm rotatable between a locked position, in which the lever arm blocks rotation of the latch receiver in a first direction, and a position in which the lever arm does not block rotation of the latch receiver in the first direction; an electrically actuated actuator mounted at least partially within the housing, the electrically actuated actuator drivably coupled to the lever arm to rotate the lever arm in at least one direction; and a first switch, with status of the first switch indicating whether the lever arm is in the locked position.

Another aspect of the invention provides a lock assembly, comprising: a housing for mounting within a cabinet; a latch receiver rotatably mounted at least partially within the housing, the latch receiver rotatable between an open position and a closed position; a lever arm rotatably mounted at least partially within the housing, the lever arm rotatable between a locked position, in which the lever arm blocks rotation of the latch receiver in a first direction, and a position in which the lever arm does not block rotation of the latch receiver in the first direction; an electrically actuated actuator mounted at least partially within the housing, the electrically actuated actuator drivably coupled to the lever arm to rotate the lever arm in at least one direction; and a microprocessor within the housing, the microprocessor configured to command operation of the electrically actuated actuator to drive the lever arm from the locking position.

Another aspect of the invention provides an assembly including a lock mechanism, comprising: a latch receiver rotatably mounted at least partially within the housing; a lever arm rotatably mounted at least partially within the housing, the lever arm rotatable between a locked position, in which the lever arm blocks rotation of the latch receiver in a first direction, and a position in which the lever arm does not block rotation of the latch receiver in the first direction; an electrically actuated actuator mounted at least partially within the housing, the electrically actuated actuator drivably coupled to the lever arm to rotate the lever arm in at least one direction; a first switch operated by the latch receiver, with status of the first switch indicating whether the locking arm is in the locked position; and an undermount drawer slide including a pin for engagement with the latch receiver.

These and other aspects of the invention are more fully comprehended upon review of this disclosure.

DETAILED DESCRIPTION

Figure 1:
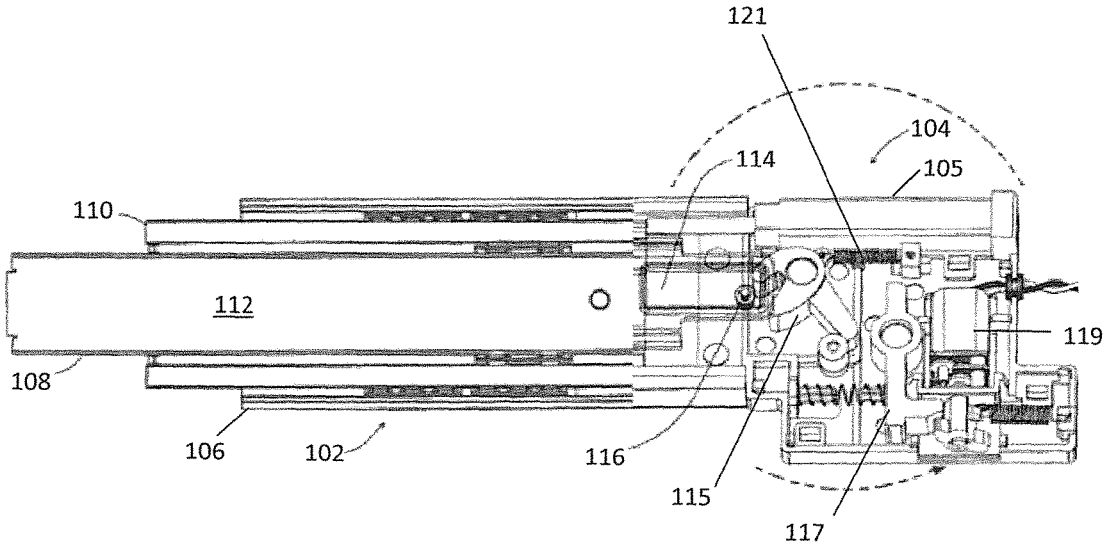
FIG. 1 illustrates a drawer slide with a lock mechanism in accordance with aspects of the invention.

FIG. 1 illustrates a view of a drawer slide 102 with a lock mechanism 104 in accordance with an embodiment of the present invention. Generally, in the embodiment of FIG. 1, a latch arm is positioned on a portion of a drawer slide member that is intended to be mounted to and move with a drawer and the lock mechanism is coupled to a drawer slide member that is intended to be mounted to and maintained in position with respect to a cabinet. As illustrated the lock mechanism is coupled to a portion of a drawer slide member intended to be mounted to a cabinet, although in some embodiments the lock mechanism may be mounted to the cabinet. In most embodiments, the lock mechanism is dimensioned so as to fit within an operating envelope of the drawer slide, and in some embodiments the lock mechanism is mounted within the operating envelope of the drawer slide. The operating envelope of the drawer slide is generally a space having a width less than or equal to spacing between a cabinet wall and a drawer and having a height of approximate or less than a height of a drawer. In some embodiments the lock mechanism is dimensioned to fit within a profile of the drawer slide. In some embodiments, the thickness of the lock mechanism, and/or the components comprising components of the lock mechanism, is approximately ½ inch, although in some embodiments the thickness is ⅜ inch, and in some embodiments the thickness is ¾ inch.

The lock mechanism includes a latch receiver 115. The latch receiver receives the latch arm when the drawer slide is in or approximate a closed position. The latch receiver is maintained in locked position by a lever arm 117, which is moveable between a locking position and an unlocking position by activation of a motor 119. In some embodiments the latch receiver is maintained in the locked position by engagement with a top of the lever arm. In some embodiments, for example as illustrated in FIG. 1, the latch receiver is biased towards an open or unlocked position by a spring 121. Movement of the lever arm to the unlocking position, for example using a motor and associated driving mechanism, releases the latch receiver to the unlocked position.

As illustrated in the embodiment of FIG. 1, the drawer slide 102 is a three member telescopic drawer slide, with an outer slide member 106 configured for mounting to a cabinet, an inner slide member 108 configured for mounting to a drawer, and an intermediate slide member 110 coupled between the outer slide member and the inner slide member. Each of the three slide members include a longitudinal web (with for example the longitudinal web of the inner slide member 108 identified by reference numeral 112) with bearing raceways along the length of the web. In various embodiments, greater or fewer numbers of slide members are used, and in various embodiments different types of drawer slide members may be used, for example over and under slides, undermount slides, friction slides, or other types of slides.

The three drawer slide members, which are slidably or rollably coupled by way of ball bearings in many embodiments, are arranged with the intermediate slide member nested within the outer slide member, and the inner slide member in turn nested within the intermediate slide member. When mounted to a cabinet and a drawer, with the slide in the closed position the intermediate slide member and the inner slide member are substantially within the volume of the outer slide member.

In the embodiment illustrated in FIG. 1, the latch arm is carried by the inner slide member, with the latch arm in the form of a pin 116 that extends from the web of the inner slide member and towards the web of the intermediate slide member. Preferably the pin extends towards the web of the intermediate a distance calculated to allow the pin to move in an unobstructed fashion past the intermediate slide member and elements associated with the intermediate slide member, such as bearing retainers, while still having sufficient length to engage the latch receiver. As shown in the embodiment of FIG. 1, the pin extends from an extension 114 of the web of the inner slide member. The extension 114 (shown partially clear for clarity) extends about a rear of the inner slide member. The extension in some embodiments, and as illustrated in FIG. 1, has a longitudinal width less than a latitudinal width of the longitudinal web of the inner slide member.

The pin may be welded or otherwise attached to the extension of the inner slide member, for example by riveting, with the pin being a rivet. In other embodiments the pin may be formed of the material of the inner slide member, and may for example be in the form of a post or other form punched or pressed from the material of the inner slide member.

The lock mechanism includes components configured to work in combination to capture the pin within the latch receiver and secure the inner slide member in the closed or locked position. Conversely, the components of the lock mechanism may also be activated to release the pin from the latch receiver and thus, release the inner slide member to allow it to return to the open position. The latch receiver captures the pin, such that the pin, and therefore the inner slide member, is prevented from moving to an open position. Thus, the pin may be considered a latch arm, and the pin and the latch receiver may together be considered a latch.

An automated open-assist mechanism 105 is provided within the housing to provide an open-assist feature for the drawer slide and drawer. In one embodiment, the open-assist mechanism is positioned in the housing so as to engage a portion of a drawer slide assembly, for example an intermediate slide member. The open-assist mechanism includes a spring housing which incorporates a plunger coupled to a biasing member, such as a spring. Operationally, in one embodiment, upon closing of the drawer slides, the plunger is contacted by the intermediate slide member, which causes the plunger to compress the biasing member within the housing. The biasing member therefore biases the intermediate slide member forward while the inner slide member is locked in position. When the latch receiver moves to the unlocked position, however, the bias provided by the biasing member pushes the intermediate slide member via the plunger, forward, carrying the inner slide member and drawer forward to at least a slightly open position. In some embodiments, however, functions of the open-assist mechanism may be provided by a spring, discussed below, which normally biases the latch receiver to the open position.

Figure 2:
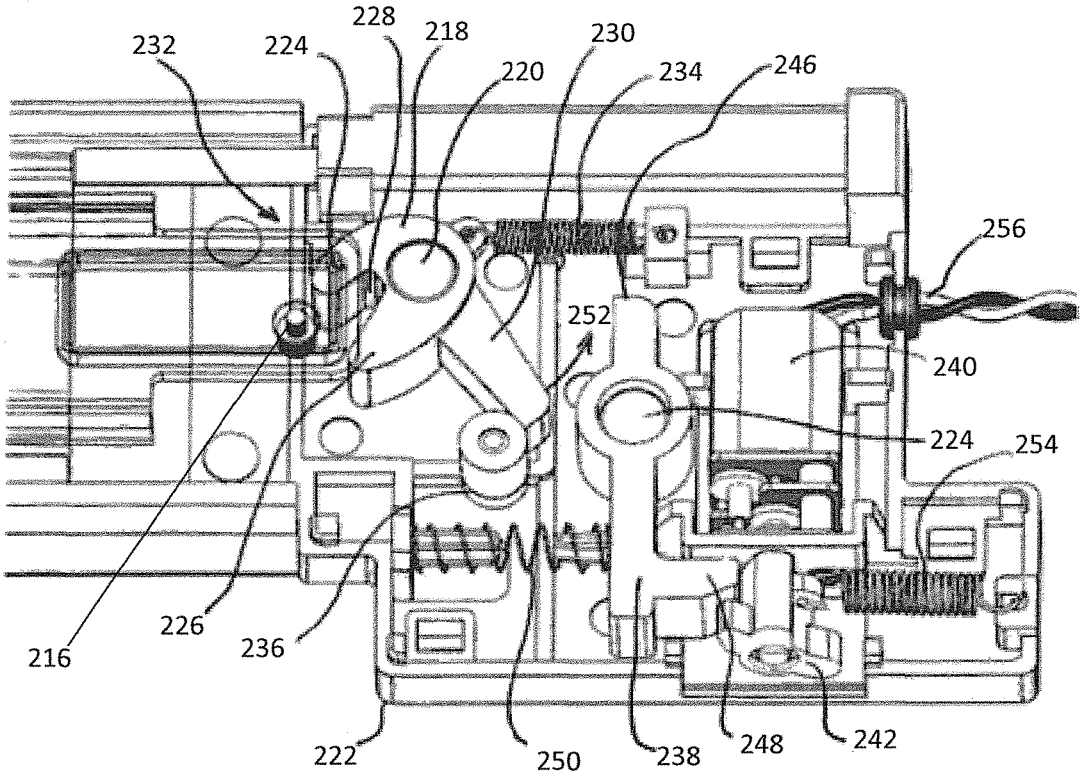
FIG. 2 shows a magnified view of portions of FIG. 1.

As shown in the embodiment illustrated in FIG. 2, which shows a magnified view of portions of the embodiment of FIG. 1, a lock mechanism includes a latch receiver 218 rotatably mounted using a screw or rivet 220 to a housing base 222. Alternately, in some embodiments the lock mechanism, or in some embodiments the latch receiver, may be mounted to an outer slide member or a cabinet frame. The latch receiver is generally U-shaped, defined by two legs that extend from the latch receiver, a first leg 224 and a second leg 226, with the first and second legs defining a basin 228 therebetween for receiving a pin 216. A third leg 230 extends from one side of the of the generally U-shaped latch receiver approximately perpendicular to the basin. In the open or unlocked position the opening of the basin faces towards a "front" end 232 of the lock mechanism. In this position, the pin is allowed to move in or out of the basin, thus permitting forward movement or extension of the inner slide member, and therefore opening of the drawer coupled to the inner slide member.

In the embodiment of FIG. 2, the latch receiver 218 is biased to the open or unlocked position by a first spring 234. The first spring is coupled to the latch receiver at a position approximately on the opposite side of the latch receiver relative to the basin. The first spring is coupled at its other end to the housing base via a stanchion or post extending therefrom to provide a counteraction to create a spring force when the latch receiver is rotated to the closed position, with the first spring therefore biasing (rotating) the latch receiver to the open position. In some embodiments the first spring has sufficient force to kick-out the inner slide member, providing an alternative open-assist mechanism.

A bumper 236 is positioned to engage the third leg 230 of the latch receiver when the latch receiver is in the open position. Preferably the bumper includes a soft compliant shell, for example of rubber, to reduce noise generated by contact of the third leg and the bumper. The bumper is positioned such that its engagement with the third leg counters the bias from the first spring to cause the latch receiver to stop rotating as the basin is positioned to receive the pin. The constant biasing of the latch receiver by the first spring and the counteraction of this bias by the third leg against the bumper ensures that the latch receiver is held in place and does not inadvertently move out of position.

With reference also to FIG. 1, closing of the drawer slide assembly causes the pin 116 to engage the latch receiver and force the inner slide member and the latch receiver into the closed or locked position. During closure of the drawer slide assembly the opening of the basin is rotated approximately perpendicular to direction of travel of the drawer slide 102 with the pin captured within the basin between the first and second legs. While in this position, the first leg 224 of the generally U-shaped latch receiver prevents forward movement of the pin, and therefore prevents forward movement of the inner slide member and drawer, resulting in the drawer being locked in the closed position.

Referring again to FIG. 2, the lock mechanism also includes a drive assembly that is used to release the pin from the latch receiver upon activation of the drive assembly. The drive assembly components include a lever arm 238, a motor 240 and a motor cam 242. The motor rotates a spindle, which causes rotation of the motor cam, in some embodiments through the use of gearing. A lever arm 238 is positioned by the drive assembly for locking and unlocking the latch receiver.

The lever arm is substantially flat and generally of rectangular shape. A hole 224 is defined on the lever arm at approximately a third of the length from a top edge 246 of the lever arm, for insertion of a pin or rivet for mounting to the housing base. The pin or rivet provides a fulcrum for the lever arm upon which to rotate. A cam follower 248 is formed at the opposite end from the top edge of the lever arm and is configured to engage with the motor cam.

The lever arm is biased to a ready or "locking" position shown in FIG. 2, with a top of the lever arm in the travel path of the third leg 230 of the latch receiver, by a second spring 250. When in the ready position, the second spring also biases the cam follower against the motor cam. In one embodiment, the surface of motor cam is designed such that in one cycle (e.g. quarter turn, half turn) of the operation of motor the motor cam rotates to a camming position, pushing on the surface of the cam follower an amount sufficient to rotate the lever arm out of the travel path 252 of the third leg. Upon deactivation of the motor, the motor cam may be rotated back to an uncammed position using a third spring 254. The third spring is coupled to the motor cam and a stanchion so as to bias the motor cam to an uncammed position. Upon deactivation of the motor, the third spring overcomes drag of the unactivated motor to return the motor cam to the uncammed position. In addition, in some embodiments, and as illustrated in FIG. 2, the motor cam includes a camming stop and an uncammed stop, both in the form of arms extending from the motor cam. The stops serve to prevent over rotation of the cam, and the motor spindle, in the cammed and uncammed positions, respectively.

The motor cam operationally engages the cam follower to rotate the lever arm to an open position, with the top edge of the lever arm being moved away from a locking engagement with the third leg of the latch receiver. The motor cam is operationally coupled to motor such that rotation of the motor causes the motor cam to push against the cam follower to overcome the spring force provided by the second spring and the third spring, and rotate the lever arm such that the third leg of the latch receiver clears the top of the lever arm.

The motor 240 is powered via electric wiring 256. Power may be supplied to the motor by or through batteries, or power outlets commonly found in residential or commercial settings, with the power supplied by a utility or back-up generator or the like. The motor may be any motor with sufficient torque capability to overcome spring or other forces to rotate the lever arm when desired. For example, the motor may be a gear motor, stepper motor and the like.

Generally, the motor is activated when desired with the use of a button, switch or similar device. In some embodiments drive circuitry for the motor may be provided, which may be activated by entry of a password or identification number by way of a keypad, by a signal, preferably encoded, from a wireless transmitter, or by some other way of receipt of a signal, preferably coded, indicating authorized opening of the drawer is requested.

Figure 3:
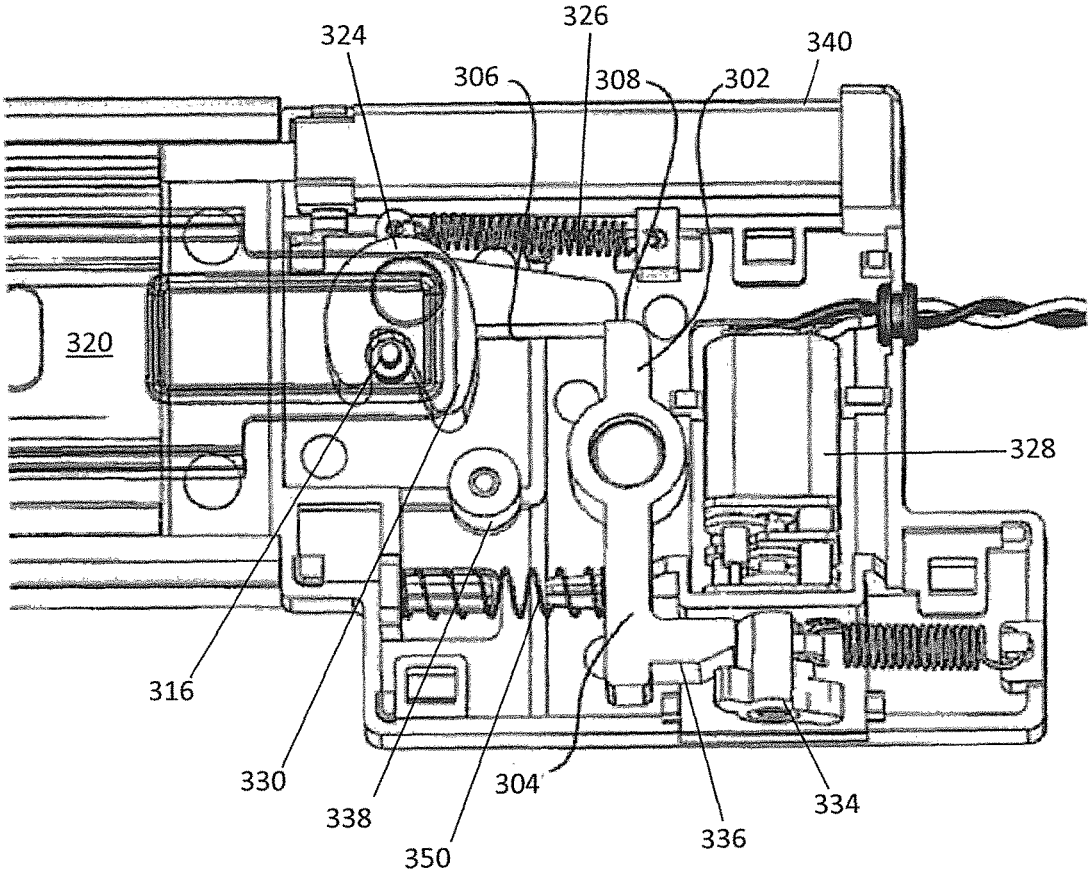
FIG. 3 illustrates the device of FIG. 1 in a locking position.

FIG. 3 is an illustration of the device of FIG. 2 in a locking position in accordance with an embodiment of the invention. For example, when access to the contents of the drawer is complete, a user may close the drawer, closing the drawer slide, causing the inner slide member to move toward the lock mechanism. As in FIG. 2, a pin 316 extends perpendicularly from a rear position of a web 320 of an inner slide member of a drawer slide assembly. A latch receiver 324 is positioned in a travel path of the pin, with the latch receiver including a basin for receiving the pin. As illustrated in FIG. 3, the pin is in the basin of the latch receiver. The latch receiver is normally biased by a first spring 326 to an open position, with the basin positioned to receive the pin, with the movement of the pin overcoming the first spring bias to rotate the latch receiver to a closed position. The latch receiver is maintained in the closed position as shown in FIG. 3, by a lever arm 302, which, upon activation of a motor 328, releases the latch receiver.

Accordingly, as the inner slide member is moved towards the closed position the pin reaches the basin of the latch receiver. As the user continues to slide the drawer closed, the pin is forced against a second leg 330 of the generally U-shaped latch receiver, which is in the travel path of the pin. The force of the pin against the second leg overcomes the bias of the first spring 326 to rotate the latch receiver from the open or unlocking position to the closed or locking position shown in FIG. 3.

Rotation of the latch receiver causes a third leg 306 of the latch receiver to also rotate away from the bumper. As shown in FIG. 3, the lever arm is in the travel path of the third leg of the latch receiver. Accordingly, the third leg of the latch receiver contacts or bumps the lever arm while rotating. However, the rotational force provided by the pin against the second leg of the latch receiver is sufficient to overcome the spring force provided by a second spring 350 engaged with and holding the lever arm in its ready or locking position relative to the latch receiver. A top end 308 of the lever arm 302 is therefore pushed out of the way by the third leg and made to rotate about the fulcrum, or pivot point. The rotation of a bottom end of the lever arm 304 causes the second spring to be compressed.

As shown in FIG. 3, however, due to the bias created by the compressed second spring against the bottom end of the lever arm, the lever arm returns to the locking position after the third leg has cleared a top end of the lever arm 308. Engagement between the top end of the lever arm and the bottom edge of the third leg prevents the latch receiver from rotating back to the open position, thus locking the pin, the inner slide member, and the drawer in a closed position.

Upon activation of the motor, for example, by the depression of a button, the throwing of a switch, after drive circuitry receives a coded signal, or through other activation means, the latch receiver is returned to its open position. Activation of the motor rotates a motor cam 334. The engagement between the surface of the motor cam and the surface of a cam follower 336 of the lever arm is done with sufficient force to overcome the bias of the second spring and any friction between the top edge of the lever arm and the bottom edge of the third leg to rotate the lever arm about its pivot point. The rotation of the lever arm moves the top edge of the lever arm out of the travel path of the third leg of the latch receiver. With the third leg free from contact with the lever arm, the first spring biases the latch receiver to the unlocking position, swinging the third leg along its travel path until the third leg once again engages with a bumper 338 to stop the rotation. The pin, and therefore the inner slide member and drawer, are free to move to a forward extended position.

Forward movement of the pin is assisted by a compression spring (not shown) in a housing 340. The compression spring has an end coupled to a plunger, which bears against an intermediate slide member of the drawer slide assembly. As the drawer slide is closed, the intermediate slide member, via the shaft, compresses the compression spring. Once the latch receiver releases the pin, the compression spring provides an open-assist force pushing the intermediate slide member, and therefore the inner slide member and drawer, towards an open position.

Figure 4:
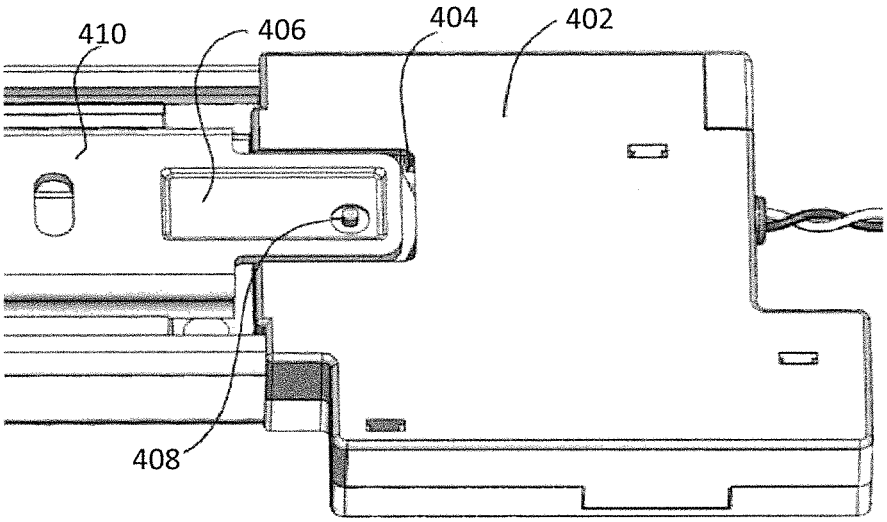
FIG. 4 is a front view of a housing for a lock mechanism coupled to a drawer slide assembly in accordance with aspects of the invention.

FIG. 4 is a view including a front of a housing for a lock mechanism coupled to a drawer slide assembly. As illustrated, the drawer slide assembly is in the closed or locking position. In this embodiment, a top cover 402 includes an open slot 404 to receive an extension 406 of an inner slide member 410. The extension carries a pin 408 which engages a latch member positioned below the top cover and within an outline defined by the open slot.

Figure 5:
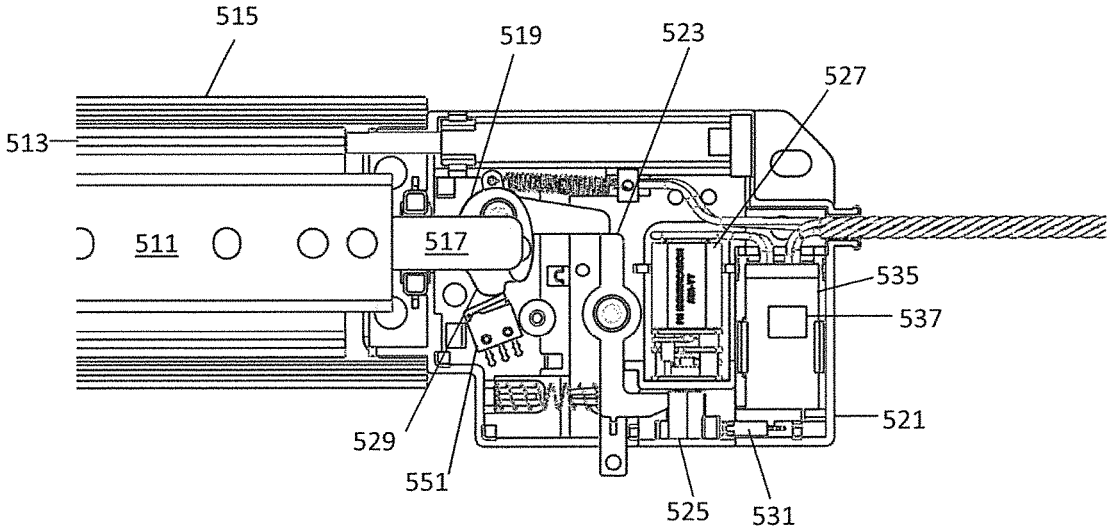
FIG. 5 illustrates another drawer slide with a lock mechanism in accordance with aspects of the invention.
Figure 6:
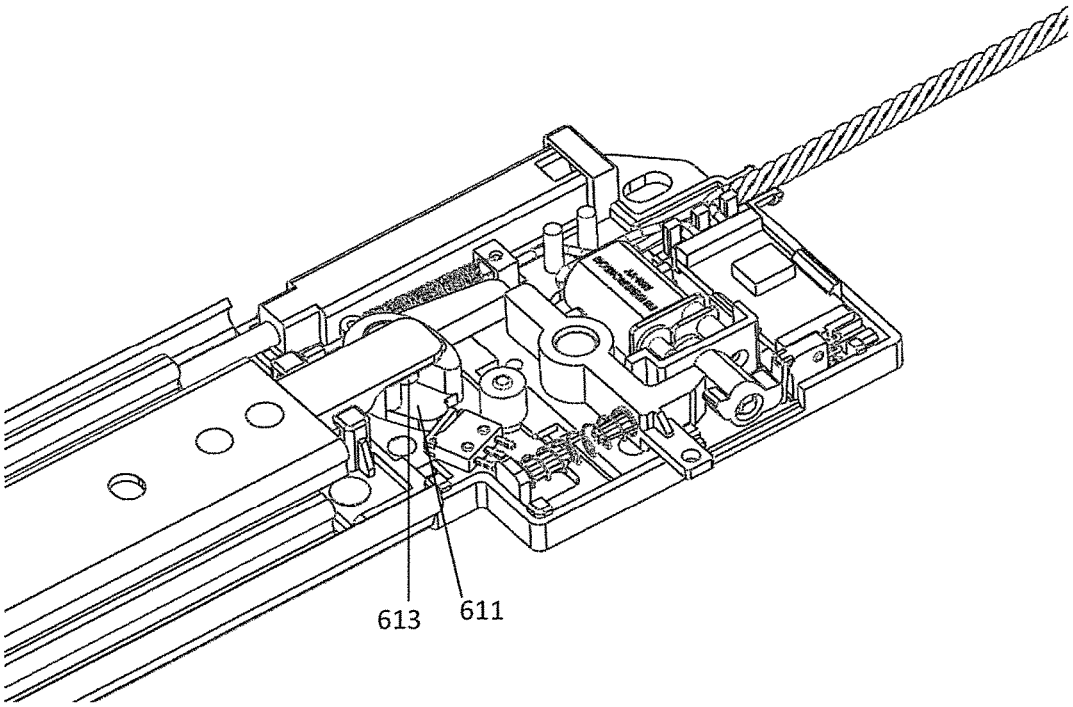
FIG. 6 illustrates a perspective view of the drawer slide with lock mechanism of FIG. 5.

FIGS. 5 and 6 illustrate a further drawer slide with an electronically actuated locking mechanism. The further drawer slide with an electronically actuated locking mechanism includes many similar components as the device of FIGS. 1-4. The drawer slide of FIG. 5 includes an inner slide member 511 nested within an intermediate slide member 513, which in turn is nested within an outer slide member 515. The rear of the inner slide member includes a tab 517 which extends from and in a plane defined by a web of the inner slide member. The tab includes a pin (partially shown as 613 in FIG. 6), which is received by a latch receiver 519, as discussed with respect to the embodiments of FIGS. 1-3. The latch receiver is within a housing 521, coupled to a rear of the slide assembly. As with previously discussed embodiments, a locking arm 523 maintains the latch receiver in a locked position, with the locking arm normally biased to a locking position by a spring. A cam 525 operated by an electrically actuated actuator, shown as a motor 527, is selectively rotated to cam the locking arm and overcome the normal bias provided by the spring and to allow the latch receiver to clear the locking arm.

The motor is commanded to operate by a microprocessor 537 mounted on a circuit board 535. The circuit board fits within a profile of an insulating sleeve, which is installed onto a base holding the locking mechanism. The insulating sleeve electrically insulates the circuit board and microprocessor from, for example, metal components of the locking assembly, as well as providing some protection from spurious debris that may enter the lock mechanism or otherwise be generated during use of the lock mechanism.

The microprocessor may, in various embodiments, take the form of a microprocessor, a digital signal processor (DSP), an FPGA, or a custom or semi-custom ASIC. The microprocessor receives signals to lock or unlock the assembly from an external device, for example an access controller. In some embodiments the access controller, which may be used to externally command locking or unlocking of a drawer mounted to the drawer slide, provides a first voltage signal, for example by applying a positive voltage signal, or a negative voltage signal, to command an unlocked state for the assembly, and removes the first voltage to command a locked state. Such a configuration of signals may allow for increased drawer security, or security of other receptacle locked by the locking mechanism, in the event of absence of signals from the access controller, for example in the event of loss of power to the access controller or interruption of signal paths between the microprocessor and access controller.

In various embodiments the microprocessor includes a power converter to accept a wide range of input voltages and provide, when enabled, a generally constant voltage in absolute terms, with the output switchable between a positive relatively constant voltage or a negative relatively constant voltage. The availability of the switchable complementary output, when on or enabled, allows for use of a single wide range voltage input to drive the motor in either of two directions. In some embodiments the microprocessor, or other circuitry on the circuit board, accepts, for example, an input voltage approximate a 5V-30V range, and provides as an output a voltage of about ±5V. In some embodiments a first power converter is used to translate an input voltage in the 5V-30V range to a 5V voltage, and a second power converter is used to switchably convert voltages supplied to the motor to −5V, 0V, or 5V, for example as commanded by the microprocessor.

In some embodiments the microprocessor commands the motor to effectively drive the lever arm from a locked position to an unlocked position by driving the motor in a first direction for a predetermined period of time, or through a predetermined number of steps, for example for a stepper motor. Similarly, the microprocessor may command the motor to effectively drive the lever arm from the unlocked position to the locked position by driving the motor in a second direction, opposite the first direction, for a predetermined period of time, or through a predetermined number of steps. In this regard, the presence of cam stops, for example provided by the protrusions on the cam, provide positive known stop positions for the cam, and the motor, in the locked and unlocked positions, increasing reliability of operations over time.

A forward end of the latch receiver further includes, when compared to the latch receiver of prior embodiments, an extending base surface forming a flange 529, which may also be seen in FIG. 6 as indicated by reference numeral 611. A first switch 551 is contacted and operated by the flange, with the first switch placed in a closed state when the latch arm receiver is rotated to a closed position by closing of the slide.

Similarly, a second switch 531 is positioned to be contacted by a protrusion of the cam 525 when the cam is positioned to place the locking arm 523 in the locking position, with the second switch placed into a closed state when the cam is positioned to place the locking arm in the locking position.

In some embodiments status of the switches is provided to the microprocessor. In some embodiments status of the switches is provided to some other unit, for example an access controller. Provision of the status of the switches to the microprocessor is convenient in that it allows for the microprocessor to determine if the drawer slide is open or closed, or if the locking arm is in a locking position. The microprocessor may provide this information, namely lock/unlock status of the locking mechanism and/or open/close status of the drawer, to another unit, for example an access controller, to memory, and/or to visual display devices, such as light sources. Such use of the information allows the microprocessor or the access controller to retain the information for maintenance of access records for example, or to provide visual presentation, for example by way of illumination of light sources, of drawer and lock mechanism status.

In some embodiments the switches are subminiature snap action type switches. The switches include a lever arm which is spring loaded, with position of the lever arm determining switch status. The body of the switch may be molded using a plastic material. Preferably a body of the first switch includes two holes for snapping over two corresponding posts positioned on the lock base. The posts of the lock base and the holes are preferably designed to provide an interference fit, allowing for a fastening of the switch to the assembly without the use of additional fasteners or bonding material. Preferably, the posts and the holes are sufficiently precisely located for uniform operation of the switch with respect to the latch arm receiver. Similarly, a body of the second switch may include a hole configured for an interference fit with a post of the lock base (or the insulator sleeve in some embodiments) and, in some embodiments a straight ledge of the body aligned with a corresponding straight ledge of the insulator sleeve.

Figure 7:
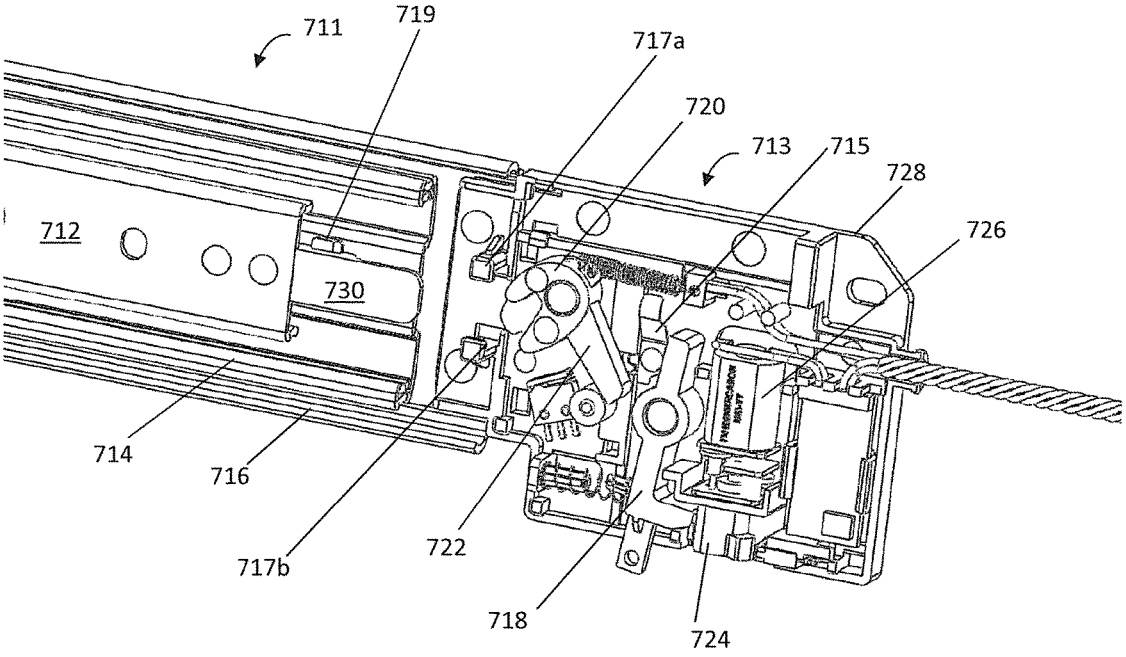
FIG. 7 illustrates a perspective view of a drawer slide with a further lock mechanism in accordance with aspects of the invention

FIG. 7 shows a further lock mechanism 713 coupled to a drawer slide 711. The lock mechanism includes a detent mechanism, with the detent mechanism provided by way of a detent mechanism for the latch receiver. The detent mechanism is useful in that the detent mechanism allows for a frictional interface on closing of a drawer coupled to the drawer slide, providing feedback to a user during operation that the drawer is closed, and retaining the drawer in the closed position, absent application of a positive force to open the drawer. In this regard, considering that the latch receiver may be normally biased to an open position, the use of a detent mechanism may be useful in that the detent mechanism allows the drawer to remain in a closed position even if the lever arm, for locking the latch receiver in the closed position, is in an unlocked state. Accordingly in some embodiments the detent mechanism, cancels out, and in some embodiments is merely sufficient to cancel out, force generated by the spring normally biasing the latch receiver to an open position.

As illustrated in FIG. 7, the drawer slide is in a partially open position and the lock mechanism is in an unlocked state. The drawer slide may be seen to be in a partially open position as an inner member 712 of the drawer slide is partially extended with respect to an intermediate slide member 714 and an outer slide member 716. The lock mechanism may be seen to be in an unlocked state as a lever arm 718, which serves to maintain a latch receiver 720 in a closed position, is in a position where the lever arm is not in the travel path of a leg 722 of the latch receiver, with the lever arm in such a position due to a cam 724 having been rotated to the camming position by a motor 726. Accordingly, the lever arm is not in a position to maintain the latch receiver in the locked position.

The lock mechanism of FIG. 7, compared to the lock mechanism in prior figures, additionally includes a leaf spring 715, somewhat in the form of a bayonet, coupled to a base 728 of the lock mechanism. The leaf spring may be coupled to the base of the lock by way of a rivet or the like. A protruding portion of the leaf spring extends into a travel path of the leg of the latch receiver, with the protruding portion positioned such that the leg of the latch receiver biases the leaf spring towards the base when the latch receiver is in the closed position. Considering that the leaf spring presses against the leg of the latch receiver in such a position, frictional forces between the leaf spring and the leg serve to normally maintain the latch receiver in the closed position. In addition, as the latch receiver moves to the closed position, the frictional force between the latch receiver leg and the leaf spring, as the latch receiver leg presses the leaf spring towards the base, produces a frictional interface, providing a detent mechanism for the lock mechanism, and for the drawer slide.

In operation, as the inner slide member moves to a closed position, the pin (not shown) on the inner slide member contacts the basin of the latch receiver, and begins to move the latch receiver towards the closed position. As the latch receiver reaches the closed position, and the leg of the latch receiver contacts the leaf spring, the contact provides a detent in the closed position. The slide member may thereafter be opened, through provision of force, such as provided by pulling on a drawer coupled to the inner slide member. Without provision of force, however, the inner slide member, and therefore the drawer coupled to the drawer slide, will remain in the closed position.

In addition, the lock mechanism also includes opposing posts 717*a,b* positioned forward of the latch receiver. The posts are positioned so as to be about either side of a tab 730 extending from the inner slide member when the inner slide member is in the closed position. The opposing posts each include a lip at their ends, with the lips facing one another and therefore facing towards a longitudinal centerline of the inner slide member. A protrusion 719 extends from the side of the tab. When the inner slide member is in the closed position, the protrusion is adjacent the post, and the lip of that post constrains movement of the protrusion, and therefore the inner slide member, in a direction away from the other slide members. Such a constraint is beneficial in that the pin is also more securely held in the basin of the latch receiver when the inner slide member is in the closed position. Of course, from the foregoing, it should be apparent that in some embodiments only a single post is used. The use of dual posts, however, allows for a reversely mounted inner slide member, or in other words an unhanded mechanism. In addition, in some embodiments two protrusions on the inner slide member may be used, with the protrusions in opposite sides of the tab, providing for increased constraint for the inner slide member.

Figure 8:
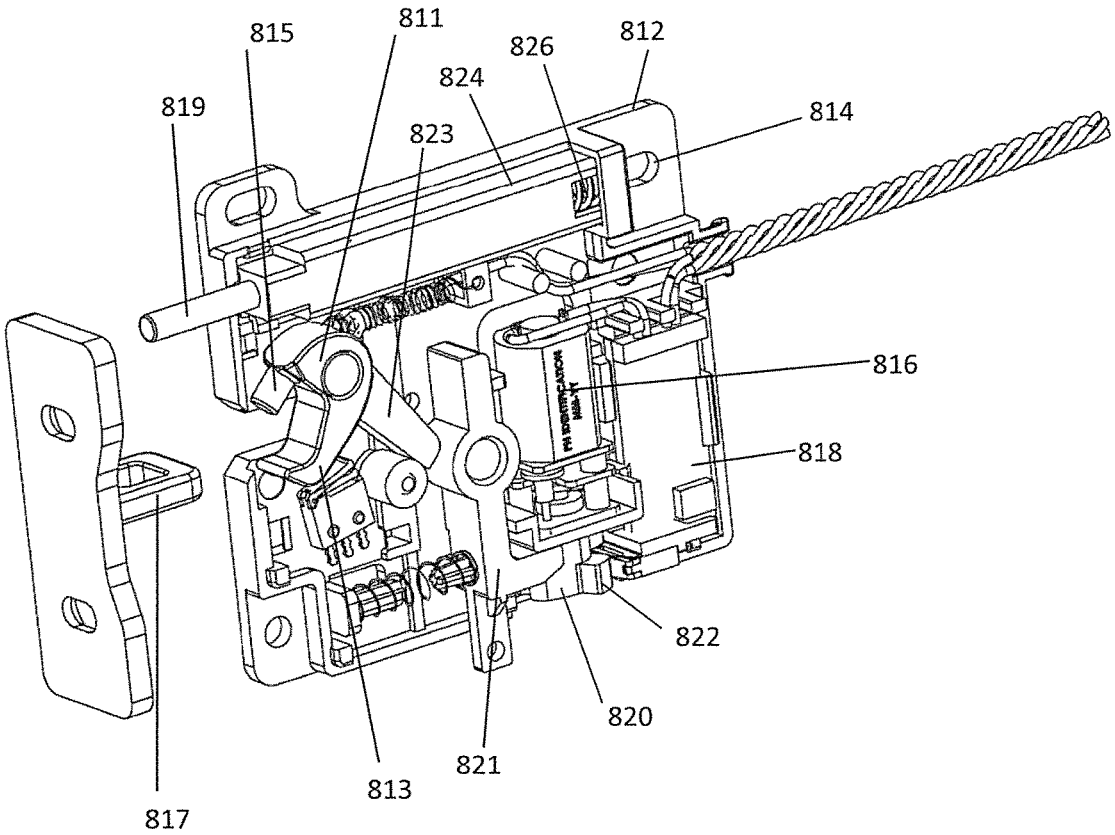
FIG. 8 illustrates a perspective view of a further lock mechanism in accordance with aspects of the invention.

FIG. 8 shows a perspective view of a further lock mechanism in accordance with aspects of the invention. The embodiment of FIG. 8 includes a base 812 with various apertures, for example an aperture 814, for mounting the base to, for example, a side of a cabinet. As with prior embodiments, the lock mechanism includes a motor 816 configured to drive a cam 820 to rotate a lever arm 821 in and out of a path of a leg 823 of a latch receiver 811. The latch receiver is configured to receive and retain a latch 817, for example coupled to a door, drawer or cover for a receptacle. In the embodiments of FIG. 8, the motor is controlled by a microprocessor included with the lock mechanism. In various embodiments, however, the motor may otherwise be controlled by signals provided by an external source, and the lock mechanism may not include a microprocessor. In the embodiment of FIG. 8, the microprocessor is on a shielded circuit board 818. The microprocessor is programmed to rotate the motor in a first direction to cause a cam to move to a cammed position, and to rotate the motor in a second direction, with for example the second direction the reverse of the first direction, to cause the cam to move to an uncammed position. In both cases, stops on the cam, for example stop 822, are positioned to contact the base in either the cammed or the uncammed position, thereby providing for a positive stop at the cammed and uncammed positions. This helps avoid inaccuracies in cam and motor spindle position over time due to small variations in rotation of the cam by the motor. The lock mechanism also includes a plunger 819 extending from a housing 824 including a spring 826, providing a self-open feature for the lock mechanism.

The latch receiver has a basin formed between a jaw 813 of the latch receiver and an opposing tooth 815. The latch receiver, in operation, is contacted by a latch, which when closed forces the latch receiver to rotate to a closed position.

As may be seen in FIG. 9, which shows a plan view of the embodiment of FIG. 8, a micro switch 913 is positioned below the jaw. The micro switch is positioned such that a lower portion of the jaw contacts the micro switch, closing the switch, when the latch receiver is in the locked position. Coupling the micro switch to the microprocessor, or some other circuit elements either within the lock mechanism or external to the lock mechanism, allows for reporting on the status of the latch receiver.

Figure 9:
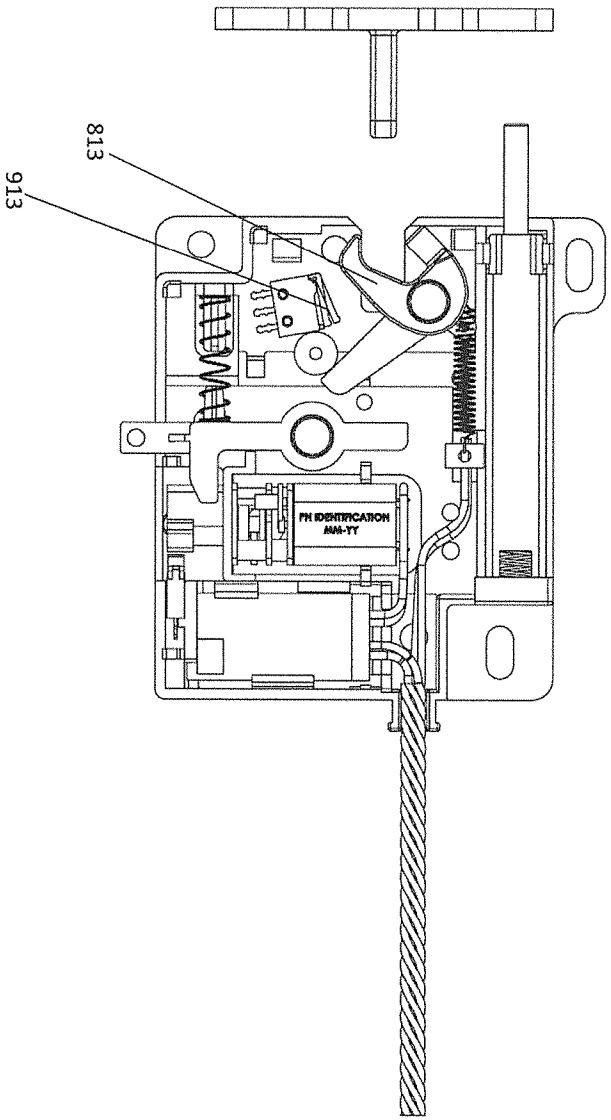
FIG. 9 illustrates a plan view of the lock mechanism of FIG. 8.
Figure 10:
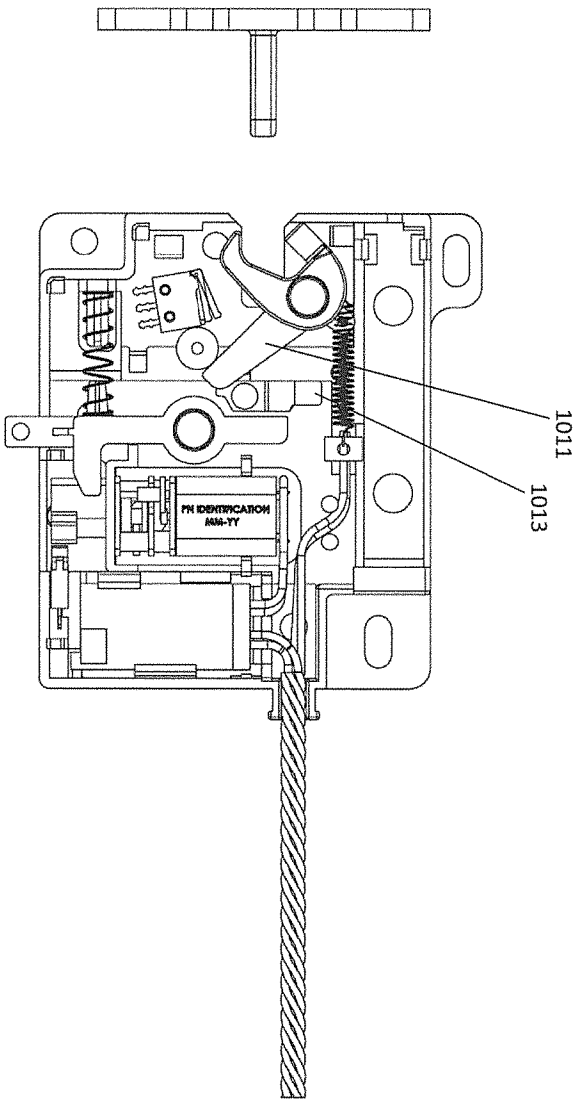
FIG. 10 illustrates a plan view of a further lock mechanism in accordance with aspects of the invention.

FIG. 10 illustrates a further embodiment of a lock mechanism. The embodiment of FIG. 10 is similar to the embodiment of FIG. 9. The embodiment of FIG. 10, however, does not include the self-open feature provided by the plunger and related components. Instead, the embodiment of FIG. 10 includes a detent mechanism. The detent mechanism, as illustrated in FIG. 10, is in the configuration of the latch receiver detent mechanism of the embodiment of FIG. 7, with a flexible spring structure 1013, illustrated in the form of a leaf spring, providing a detent at the closed position for the leg 1011 of the latch receiver.

Figure 11:
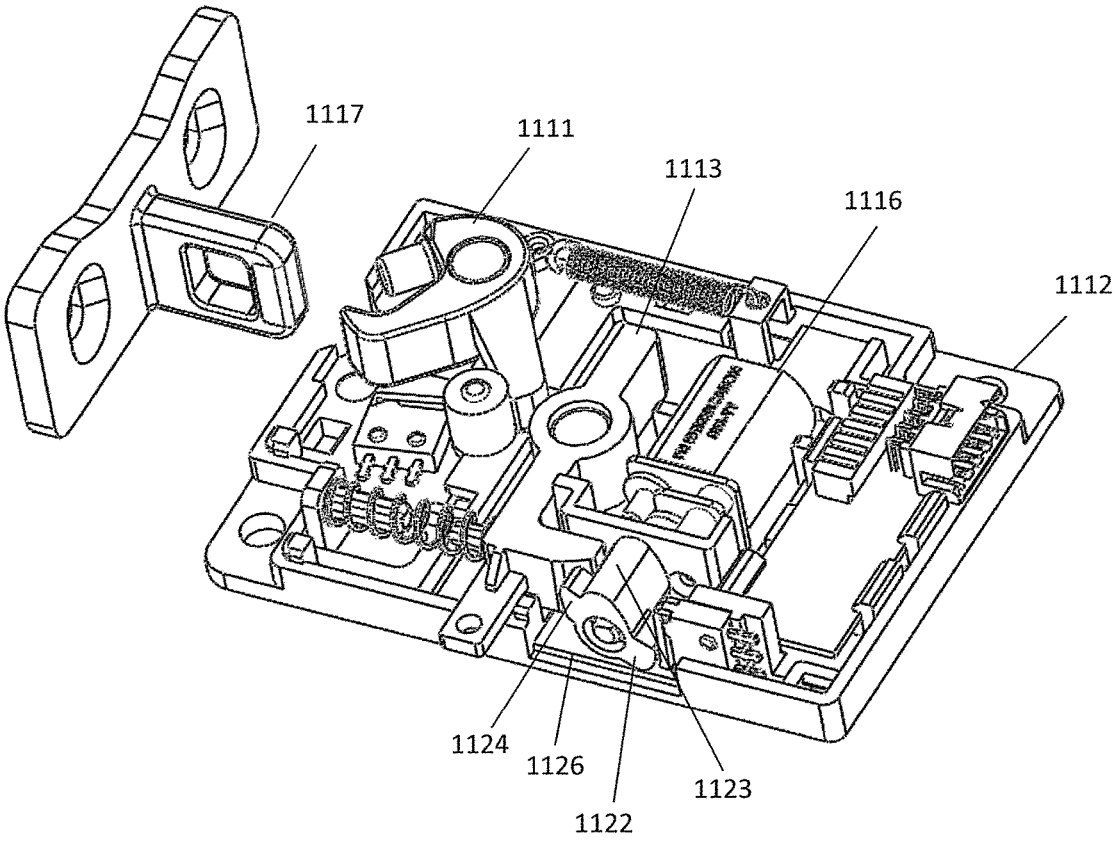
FIG. 11 illustrates a further lock mechanism in accordance with aspects of the invention.

FIG. 11 illustrates a further lock mechanism similar to that of FIGS. 9 and 10. As with the embodiments of FIGS. 9 and 10, the lock mechanism of FIG. 11 includes a latch receiver 1111 coupled to a base 1112. The latch receiver receives a latch arm 1117, and the latch receiver may be held in a locked position by a lever arm 1113. A motor 1116 is driveable to rotate the lever arm, by operation of a cam, so as to release the latch receiver. The lever arm, therefore, may be placed in a locked position, a position in which the lever arm may lock the latch receiver in a closed position, or an unlocked position, a position in which the lever arm does not impede movement of the latch receiver. To place the lever arm in the unlocked position, the motor rotates the cam to place an eccentrically extending camming surface 1123 against the lever arm, causing the lever arm to displace to the unlocked position.

The cam also includes cam stops, in the form of protrusions on the cam. The camming stops prevent over rotation of the cam, and the motor spindle, allowing for increased regularity in positioning of the cam during operation and over time. A first cam stop 1124 stops rotation of the cam in the camming position, with the camming surface 1123 displacing the lever arm to the unlocked position. The first cam stop stops rotation of the cam by contact with a base plate 1126, with the base plate preventing further rotation of the cam past the camming position. Similarly, a second cam stop 1122 stops rotation of the cam in the uncamming position, with the camming surface 1123 away from the lever arm. As with the first cam stop, the second cam stop stops further rotation of the cam by contact with the base plate. In some embodiments a base plate is not used, with for example functions of the base plate provided by the base 1112. However, in various embodiments the base 1112 (and its corresponding cover (not shown in FIG. 11)) may be of a softer material, various plastics for example, which may be damaged or deformed over time. The use of the base plate, which may be of a harder more durable material, various metals for example, may therefore be beneficial.

Figure 12:
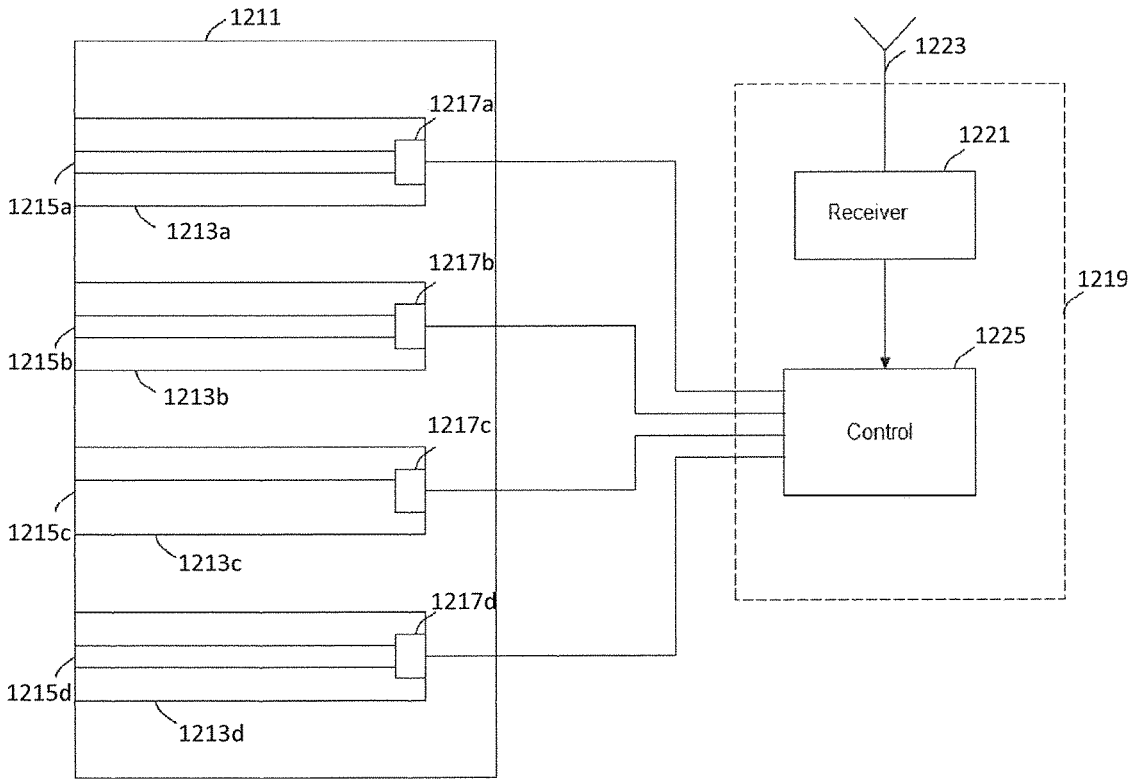
FIG. 12 is a semi-block diagram of a system in accordance with aspects of the invention.

FIG. 12 is a semi-block diagram of a system in accordance with aspects of the invention. As illustrated in FIG. 12, a cabinet 1211 has a plurality of drawers, with four drawers 1213*a-d* shown. Each of the drawers is extensibly coupled to the cabinet by a drawer slides. The drawer slides may be in the form of an undermount drawer slide, for example mounted underneath a drawer, or telescopic or other type of drawer slide, for example mounted to opposing sides of a drawer. In the example of FIG. 12 each drawer is coupled to the cabinet using a pair of telescopic drawer slides, with one telescopic drawer slide 1215*a-d* shown for each drawer.

Each of the drawer slides 1215*a-d* includes a corresponding lock mechanism 1217*a-d*, with each lock mechanism shown about the rear of a corresponding drawer slide. In some embodiments multiple or all drawer slides for a particular drawer may be equipped with a lock mechanism, in other embodiments only a single drawer slide may be equipped with a lock mechanism. The lock mechanism may be, for example, as discussed with respect to FIGS. 1, 2, 3, 8, 9, 10, or as discussed with respect to other figures herein, for example FIGS. 5 and 6. In most embodiments the locking mechanism mechanically latches drawers in the closed position, generally by restricting movement of a drawer slide member with respect to the cabinet, and through electronically driven actuation releases the drawer slide member to allow movement with respect to the cabinet. In addition, in many embodiments one or more, or all, drawer slides are also provided a push out device, for example a spring driven push out device, to at least partially open a drawer upon release of the drawer slide member.

Each of the lock mechanisms is electrically coupled to control circuitry 1225. The control circuitry, which in some embodiments may be the access controller discussed with respect to FIGS. 5 and 6, may be contained within a housing 1219, which may be within or coupled to the cabinet. In some embodiments common control circuitry is provided for all of the drawers, for example with separate electrical connections to lock mechanisms of each drawer. In other embodiments separate control circuitry may be provided for each drawer, and the separate control circuitry may be contained within separate housings. The control circuitry includes circuitry for generating a release signal, for example on a drawer-by drawer basis. In most embodiments the control circuitry receives an input signal and, based on the input signal, determines if the release signal should be generated. In many embodiments the control circuitry generates the release signal for a particular drawer if the input signal matches a defined pattern for the particular drawer. As an example, the control circuitry may be configured in some embodiments to generate a release signal for a first drawer if the control circuitry determines that a received input signal matches a code set for the first drawer, to generate a release signal for the second drawer if the control circuitry determines that a received input signal matches a code set for the second drawer, and so on.

In the embodiment shown in FIG. 12 the control circuitry receives the input signal from a receiver 1221 which is configured to receive wireless communications, for example by way of an antenna 1223, although infrared or other wireless communications means may be used in other embodiments. In some embodiments, the control circuitry may receive the input signals by way of a radio frequency identification (RFID) card reader or proximity sensor. In still other embodiments the control circuitry may receive the input signals by way of a touchpad, for example a numeric touchpad for entering codes, or other hardwired input circuitry. The receiver may be located in the same housing as the control circuitry, or, for example as may occur more often occur with use of a touchpad, external to the housing.

The control circuitry and the receiver are powered by AC utility power or generator power in some embodiments, generally converted to DC power by power conversion circuitry, which may be provided by a power supply unit. In other embodiments the control circuitry and receiver are powered by battery power. In some embodiments AC utility power or generator power may be a primary source of power, with battery power provided as a backup source of power in the event of failure of the primary source of power.

Accordingly, the invention provides a drawer slide, a locking mechanism, and a drawer slide with a locking mechanism. Although the invention has been described with respect to specific embodiments, it should be recognized that the invention comprises the novel and unobvious claims supported by this disclosure, along with their insubstantial variations.

What is claimed is:

1. An assembly including a lock mechanism, the assembly comprising:

a housing for mounting within a cabinet;

a latch receiver rotatably mounted at least partially within the housing;

a lever arm rotatably mounted at least partially within the housing, the lever arm rotatable between a locked position, in which the lever arm blocks rotation of the latch receiver in a first direction, and an unlocked position in which the lever arm does not block rotation of the latch receiver in the first direction;

an electrically actuated actuator mounted at least partially within the housing, the electrically actuated actuator drivably coupled to the lever arm by a cam in positive contact with the lever arm to rotate the lever arm in at least one direction, the cam being driven to rotate in a first direction by operation of the actuator to push on the lever arm to rotate the lever arm from the locked position to the unlocked position, the cam being driven to rotate in a second direction opposite the first direction, by operation of the actuator, to effectively drive the lever arm from the unlocked position to the locked position;

a first switch, with status of the first switch indicating whether the lever arm is in the locked position; and a leaf spring coupled to a base of the housing, the leaf spring including a protruding portion extending into a travel path of the latch receiver to produce a frictional interface between the protruding portion and the latch receiver.

2. The assembly of claim 1, wherein a first leg of the latch receiver biases the leaf spring towards the base when the latch receiver is in a closed position.

3. The assembly of claim 1, wherein the leaf spring provides a detent mechanism which cancels out force generated by a spring normally biasing the latch receiver to an open position.

4. The assembly of claim 2, wherein the latch receiver includes a second leg and a third leg defining a basin for receiving a pin in the open position and for capturing the pin in the closed position.

5. An assembly including a lock mechanism, the assembly comprising:

a housing for mounting within a cabinet;

a latch receiver rotatably mounted at least partially within the housing;

a lever arm rotatably mounted at least partially within the housing, the lever arm rotatable between a locked position, in which the lever arm blocks rotation of the latch receiver in a first direction, and an unlocked position in which the lever arm does not block rotation of the latch receiver in the first direction;

an electrically actuated actuator mounted at least partially within the housing, the electrically actuated actuator drivably coupled to the lever arm by a cam in positive contact with the lever arm to rotate the lever arm in at least one direction, the cam being driven to rotate in a first direction by operation of the actuator to push on the lever arm to rotate the lever arm from the locked position to the unlocked position, the cam being driven to rotate in a second direction opposite the first direction, by operation of the actuator, to effectively drive the lever arm from the unlocked position to the locked position;

a first switch, with status of the first switch indicating whether the lever arm is in the locked position; and a drawer slide, the drawer slide including a first slide member fixed in position with respect to the housing and a second slide member extendable from the first slide member.

6. The assembly of claim 5, further comprising means for constraining motion of the second slide member in a direction away from the first slide member when the second slide member is in a closed position.

7. The assembly of claim 5, further comprising a post positioned forward of the latch receiver, the post including a lip facing toward a longitudinal center line of the second slide member.

8. The assembly of claim 7, further comprising a tab having a protrusion, the tab extending from the second slide member, with the protrusion adjacent the post when the second slide member is in a closed position.

9. The assembly of claim 5, wherein the second slide member is coupled to the first slide member by an intermediate slide member, with the second slide member extendable from the intermediate slide member and the intermediate slide member extendable from the first slide member.

* * * * *